US006916222B2

(12) United States Patent
Oshio et al.

(10) Patent No.: US 6,916,222 B2
(45) Date of Patent: Jul. 12, 2005

(54) PROCESS OF MAKING BARRIER RIBS, ELECTRODES, AND THE LIKE FOR A PLASMA PANEL

(75) Inventors: Kiminori Oshio, Kanagawa (JP); Tomoyuki Inoue, Kanagawa (JP); Hitoshi Setsuda, Kanagawa (JP); Hiroyuki Obiya, Kanagawa (JP)

(73) Assignee: Tokyo Ohka Kogyo Co., Ltd., Kanagawa (JP)

( * ) Notice: Subject to any disclaimer, the term of this patent is extended or adjusted under 35 U.S.C. 154(b) by 292 days.

(21) Appl. No.: 10/135,482

(22) Filed: Apr. 30, 2002

(65) Prior Publication Data

US 2002/0163108 A1 Nov. 7, 2002

(30) Foreign Application Priority Data

May 1, 2001 (JP) ..... P.2001-133810

(51) Int. Cl.[7] ..... H01J 9/00
(52) U.S. Cl. ..... 445/24
(58) Field of Search ..... 445/24, 25; 430/288.1

(56) References Cited

U.S. PATENT DOCUMENTS

| | | | | |
|---|---|---|---|---|
| 6,051,368 A | * | 4/2000 | Masuko et al. | 430/288.1 |
| 6,103,452 A | | 8/2000 | Kakinuma et al. | |
| 6,184,621 B1 | | 2/2001 | Horiuchi et al. | |
| 6,372,292 B1 | | 4/2002 | Nakazato et al. | |

FOREIGN PATENT DOCUMENTS

| | | |
|---|---|---|
| EP | 0768573 | 4/1997 |
| EP | 0887833 | 12/1998 |
| JP | 63265238 | 11/1988 |
| JP | 9061996 | 3/1997 |
| JP | 147751 | 6/1997 |
| JP | 055758 | 2/1998 |
| JP | 10-55758 | 2/1998 |
| JP | 11-246638 | 9/1999 |
| JP | 338129 | 12/1999 |
| JP | 2000-007383 | 1/2000 |
| JP | 2000-053444 | 2/2000 |
| JP | 2000-243266 | 9/2000 |
| JP | 2000-268633 | 9/2000 |
| JP | 312962 | 11/2001 |

OTHER PUBLICATIONS

Chinese Office Action mailed Jun. 4, 2004, and English translation thereof.
French Search Report, Aug. 12, 2004.
Search Report (Dutch Patent Office), Nov. 6, 2002.

* cited by examiner

*Primary Examiner*—Joseph Williams
(74) *Attorney, Agent, or Firm*—Fish & Richardson P.C.

(57) ABSTRACT

A process of producing a plasma display panel has the steps of: forming a photosensitive paste composition layer on a carrier film; transferring the photosensitive paste composition layer onto a substrate; exposing the photosensitive paste composition layer; removing the carrier film; and baking the exposed composition layer to fabricate at least one of barrier ribs, electrodes, resistors, dielectrics, phosphors, a color filter array, and a black matrix.

6 Claims, No Drawings

PROCESS OF MAKING BARRIER RIBS, ELECTRODES, AND THE LIKE FOR A PLASMA PANEL

FIELD OF THE INVENTION

This invention relates to a process of producing a plasma display panel (PDP). More particularly, it relates to a process of fabricating at least one of barrier ribs, electrodes, resistors, dielectrics, phosphors, a color filter array, and a black matrix with high precision and accuracy in the manufacture of PDPs.

BACKGROUND OF THE INVENTION

In the field of image displays, with the keenest attention, intensive study has been directed to PDPs which are comparable to CRT displays in brightness and have a relatively simple structure with slimness and ease of fabricating a display screen wider than 20 inches across. A PDP is a flat display panel composed a pair of glass substrates between which a vast number of cells are arrayed, being separated by barrier ribs made of an insulating material. Each cell, acting as a pixel, contains a phosphor, which is excited by ultraviolet rays generated by a plasma discharge to emit visible light. Electrodes, resistors, dielectrics, etc. for generating plasma are provided on the substrates and in the cells. A color filter array and a black matrix are also provided for color display. The barrier ribs, electrodes, resistors, dielectrics, phosphors, color filter array, and black matrix (hereinafter referred to as barrier ribs, etc.) have been fabricated by thick film screen printing techniques in which a photo-insensitive paste containing inorganic particles is screen printed on a substrate in a pattern and baked or photolithographic techniques in which a photosensitive paste composition containing inorganic particles is applied to a substrate, irradiated with ultraviolet radiation, etc. through a photo mask, developed to leave a pattern on the substrate, and baked. However, thick film screen printing techniques have poor pattern position accuracy because a paste composition should be printed repeatedly due to the limited thickness provided by a single screen printing operation. Therefore, it has been difficult to produce a wide-screen and high-precision PDP by thick film screen printing. With photolithographic techniques, the film for forming barrier ribs, etc. is too thick for assuring sufficient photosensitivity over the whole thickness, resulting in a failure to form a highly precise pattern with sharp edges. To overcome these drawbacks of conventional PDP production techniques, JP-A-2000-7383 (The term "JP-A" as used herein means an "unexamined published Japanese patent application") proposes a process comprising transferring a film-forming material layer to a substrate, forming a resist layer thereon, exposing the resist layer to form a resist pattern, etching the film-forming material layer using the resist pattern as a mask to form a pattern, and baking the pattern. However, this process involves an increased number of steps, leading to an increase of production cost. Moreover, when a carrier film is stripped off the film-forming material layer transferred to the substrate, the film-forming material layer receives release marks due to its tackiness.

SUMMARY OF THE INVENTION

Under these circumstances, the present inventors have conducted extensive investigations and found as a result that a film-forming material layer free from release marks can be obtained by transferring a photosensitive paste composition layer formed on a carrier film onto a substrate, exposing the photosensitive paste composition layer, and then removing the carrier film and that barrier ribs, etc. can be fabricated with high precision by baking the exposed film-forming material layer. The present invention has been completed based on this finding.

An object of the present invention is to provide a process for producing a PDP having high precision barrier ribs, etc. at low cost.

The above object is accomplished by a process of producing a PDP comprising the steps of transferring a photosensitive paste composition layer formed on a carrier film onto a substrate, exposing the layer, removing the carrier film, and baking the film to fabricate at least one of barrier ribs, electrodes, resistors, dielectrics, phosphors, a color filter array, and a black matrix.

DETAILED DESCRIPTION OF THE INVENTION

The photosensitive paste composition layer is not particularly limited as long as it is sufficiently transparent to light for exposure, such as ultraviolet radiation, excimer laser beams, X-rays or electron beams and capable of forming a pattern with high precision by photolithography. Suitable photosensitive paste compositions include those comprising an inorganic powder, a binder resin for the inorganic powder, an acrylic binder resin, and a solvent and aqueous-developable photosensitive paste compositions comprising (A) a water-soluble cellulose derivative, (B) a photopolymerizable monomer, (C) an acrylic resin having a hydroxyl group, and (D) photopolymerization initiator (components (A) to (D) will inclusively be referred to as an organic component) as disclosed in JP-A-2000-268633, JP-A-2000-53444, and JP-A-11-246638. In particular, the aqueous-developable photosensitive paste composition has advantages of high transparency as well as aqueous-developability. It retains a high transmittance even with a relatively large proportion of the organic component and is therefore photolithographically capable of highly precise patterning.

Any known water-soluble cellulose derivatives can be used as component (A) with no particular limitation. Examples of useful water-soluble cellulose derivatives are carboxymethyl cellulose, hydroxyethyl cellulose, hydroxyethylmethyl cellulose, hydroxypropyl cellulose, ethylhydroxyethyl cellulose, carboxymethylethyl cellulose, and hydroxypropylmethyl cellulose. They may be used either individually or as a mixture of two or more thereof.

The photopolymerizable monomer which can be used as component (B) is not particularly limited, either. Suitable photopolymerizable monomers include ethylene glycol diacrylate, ethylene glycol dimethacrylate, triethylene glycol diacrylate, triethylene glycol dimethacrylate, trimethylolpropane triacrylate, trimethylolpropane trimethacrylate, trimethylolethane triacrylate, trimethylolethane trimethacrylate, pentaerythritol diacrylate, pentaerythritol dimethacrylate, pentaerythritol triacrylate, pentaerythritol trimethacrylate, pentaerythritol tetraacrylate, pentaerythritol tetramethacrylate, dipentaerythritol tetraacrylate, dipentaerythritol tetramethacrylate, dipentaerythritol pentaacrylate, dipentaerythritol pentamethacrylate, dipentaerythritol hexaacrylate, dipentaerythritol hexamethacrylate, glycerol acrylate, glycerol methacrylate, carboepoxy diacrylate; fumaric esters, itaconic esters and maleic esters corresponding to these (meth)acrylic esters.

The acrylic resin having a hydroxyl group which can be used as component (C) includes polymers mainly comprising at least one of an acrylic ester monomer and a hydroxyl-containing monomer and, if necessary, other copolymerizable monomers. Suitable acrylic ester monomers include acrylic acid or methacrylic acid esters with monohydric alcohols having 1 to 20 carbon atoms. Suitable hydroxyl-containing monomers include monoesters of glycols having 1 to 10 carbon atoms with acrylic acid or methacrylic acid, such as hydroxymethyl acrylate, hydroxymethyl methacrylate, 2-hydroxyethyl acrylate, 2-hydroxyethyl methacrylate, 2-hydroxypropyl acrylate, 2-hydroxypropyl methacrylate, 3-hydroxypropyl acrylate, 3-hydroxypropyl methacrylate, 2-hydroxybutyl acrylate, 2-hydroxybutyl methacrylate, 3-hydroxybutyl acrylate, 3-hydroxybutyl methacrylate, 3-hydroxybutyl acrylate, and 4-hydroxybutyl methacrylate; glycerol acrylate, glycerol methacrylate, dipentaerythritol monoacrylate, dipentaerythritol monomethacrylate, ε-caprolactone-modified hydroxyethyl acrylate, ε-caprolactone-modified hydroxyethyl methacrylate, and epoxy ester compounds such as 2-hydroxy-3-phenoxypropyl acrylate.

The other monomers copolymerizable with the acrylic ester monomer and the hydroxyl-containing monomer include α,β-unsaturated carboxylic acids, such as acrylic acid, methacrylic acid, itaconic acid, citraconic acid, maleic acid, and fumaric acid, and anhydrides or half esters thereof; α,β-unsaturated carboxylic acid esters, such as methyl acrylate, ethyl acrylate, n-propyl acrylate, isopropyl acrylate, n-butyl acrylate, isobutyl acrylate, sec-butyl acrylate, cyclohexyl acrylate, 2-ethylhexyl acrylate, stearyl acrylate, methyl methacrylate, ethyl methacrylate, n-propyl methacrylate, isopropyl methacrylate, sec-propyl methacrylate, n-butyl methacrylate, isobutyl methacrylate, sec-butyl methacrylate, cyclohexyl methacrylate, 2-ethylhexyl methacrylate, stearyl methacrylate, 2,2,2-trifluoromethyl acrylate, and 2,2,2-trifluoromethyl methacrylate; styrene and derivatives thereof, such as α-methylstyrene and p-vinyltoluene. Also included are acrylonitrile, methacrylonitrile, acrylamide, methacrylamide, vinyl acetate, glycidyl acrylate, and glycidyl methacrylate. These comonomers may be used either individually or as a combination thereof.

The photosensitive paste composition preferably comprises 10 to 50 parts by weight, particularly 20 to 40 parts by weight, especially 25 to 35 parts by weight, of water-soluble cellulose derivative as component (A) and 50 to 90 parts by weight, particularly 60 to 80 parts by weight, especially 65 to 75 parts by weight, of the photopolymerizable monomer as component (B) per 100 parts by weight of the total of components (A) and (B). Where the amounts of these components are less or more than the respective preferred ranges, the composition tends to fail to assure sufficient precision in patterning and have reduced light transmission. For example, if the proportion of component (B) is less than 50 parts, photopolymerization of the composition tends to be insufficient so that the image area dissolves in developing, resulting in a failure of image formation. If the proportion of component (B) exceeds 90 parts, fine line resolution reduces.

The photosensitive paste composition preferably comprises 50 to 90 parts by weight, particularly 60 to 80 parts by weight, especially 60 to 70 parts by weight, of water-soluble cellulose derivative as component (A) and 10 to 50 parts by weight, particularly 20 to 40 parts by weight, especially 30 to 40 parts by weight, of the hydroxyl-containing acrylic resin as component (C) per 100 parts by weight of the total of components (A) and (C). Where the amounts of these components are less than or more than the respective preferred ranges, the composition tends to fail to assure sufficient precision in patterning and have reduced light transmission. For example, a proportion of component (C) less than 10 parts is insufficient for development resistance, leading to an imaging failure. If the proportion of component (C) exceeds 50 parts, developability reduces to cause some part of non-exposed area to remain.

Any known photopolymerization initiator can be used as component (D). Included are benzophenones, benzoins, benzoin alkyl ethers, acetophenones, aminoacetophenones, benzils, benzyl alkyl ketals, anthraquinones, ketals, and thioxanthones. Examples are 2,4-bis(trichloromethyl)-6-(3-bromo-4-methoxy)phenyl-s-triazine, 2,4-bis(trichloromethyl)-6-(2-bromo-4-methoxy)phenyl-s-triazine, 2,4-bis(trichloromethyl)-6-(3-bromo-4-methoxy)styrylphenyl-s-triazine, 2,4-bis(trichloromethyl)-6-(2-bromo-4-methoxy)styrylphenyl-s-triazine, 2,4,6-trimethylbenzoyldiphenylphosphine oxide, 1-[4-(2-hydroxyethoxy)phenyl]-2-hydroxy-2-methyl-1-propan-1-one, 2,4-diethylthioxanthone, 2,4-dimethylthioxanthone, 2-chlorothioxanthone, 1-chloro-4-propoxythioxanthone, 3,3-dimethyl-4-methoxybenzophenone, benzopheneone, 1-(4-isopropylphenyl)-2-hydroxy-2-methylpropan-1-one, 1-(4-dodecylphenyl)-2-hydroxy-2-methylpropan-1-one, 4-benzoyl-4'-methyl sulfide, 4-dimethylaminobenzoic acid, methyl 4-dimethylaminobenzoate, ethyl 4-dimethylaminobenzoate, butyl 4-dimethylaminobenzoate, 2-ethylhexyl 4-dimethylaminobenzoate, 2-isoamyl 4-dimethylaminobenzoate, 2,2-diethoxyacetophenone, benzyl dimethyl ketal, benzyl-β-methoxyethyl acetal, 1-phenyl-1,2-propanedione-2-(O-ethoxycarbonyl) oxime, methyl o-benzoylbenzoate, bis(4-dimethylaminophenyl) ketone, 4,4'-bisdiethylaminobenzophenone, benzil, benzoin, benzoin methyl ether, benzoin ethyl ether, benzoin isopropyl ether, benzoin n-butyl ether, benzoin isobutyl ether, p-dimethylaminoacetophenone, p-t-butyltrichloroacetophenone, p-t-butyldichloroacetophenone, thioxanthone, 2-methylthioxanthone, 2-isopropylthioxanthone, dibenzosuberone, α,α-dichloro-4-phenoxyacetophenone, pentyl 4-dimethylaminobenzoate, and 2-(o-chlorophenyl)-4,5-diphenylimidazolyl dimer. They may be used either individually or as a combination of two or more thereof.

The photopolymerization initiator is suitably used in an amount of 0.1 to 10 parts by weight, preferably 0.2 to 5 parts by weight, per 100 parts by weight of the total of components (A) and (B). Where the amount of the initiator is less than 0.1 part, the composition has reduced curability. Where it is more than 10 parts, absorption by the initiator tends to cause undercure in the vicinity of the substrate.

If desired, the photosensitive paste composition can comprise additives, such as ultraviolet absorbers, sensitizers, sensitization assistants, polymerization inhibitors, plasticizers, thickeners, organic solvents, dispersants, defoaming agents, and organic or inorganic suspension stabilizers.

Examples of useful sensitizers, which are added to improve the sensitivity, are 2,4-diethylthioxanthone, isopropylthioxanthone, 2,3-bis(4-diethylaminobenzal) cyclopentanone, 2,6-bis(4-dimethylaminobenzal) cyclohexanone, 2,6-bis(4-dimethylaminobenzal)-4-methylcyclohexanone, 4,4-bis(dimethylamino) benzophenone (Michler's ketone), 4,4-bis(diethylamino) benzophenone, 4,4-bis(dimethylamino)chalcone, 4,4-bis (diethylamino)chalcone, p-dimethylaminocinnamylideneindanone, p-dimethylaminobenzylideneindazone, 2-(p-dimethylaminophenylvinylene)isonaphthothiazole, 1,3-bis(4-dimethylaminobenzal)acetone, 1,3-carbonyl-bis(4-diethylaminobenzal)acetone, 3,3-carbonyl-bis(7-diethylaminocoumarin), N-phenyl-N-ethylethanoamine, N-phenylethanolamine, N-tolyldiethanolamine, N-phenylethanolamine, isoamyl dimethylaminobenzoate, isoamyl diethylaminobenzoate, 3-phenyl-5-benzoylthiotetrazole, and 1-phenyl-5-ethoxycarbonylthiotetrazole. These sensitizers may be used either individually or as a combination of two or more thereof.

Examples of useful polymerization inhibitors, which are added to improve heat stability during storage, include hydroquinone, hydroquinonemonoesters, N-nitrosodiphenylamine, phenothiazine, p-t-butylcatechol, N-phenylnaphthylamine, 2,6-di-t-butyl-p-methylphenol, chloranil, and pyrogallol.

Examples of suitable plasticizers which are added to improve conformability to a substrate include dibutyl phthalate (DBP), dioctyl phthalate (DOP), polyethylene glycol, glycerol, and dibutyl tartrate.

Examples of defoaming agents, which can be added to reduce air bubbles in the paste or film thereby to reduce void formation on baking, include alkylene glycols (e.g., polyethylene glycol having a molecular weight of 400 to 800), silicone defoaming agents, and higher alcohols.

The inorganic powder which can be used in the photosensitive paste composition is not particularly limited as long as it is transparent to light used for exposure. Included are glass, ceramics (e.g., cordierite), and metals. Examples are powder of borosilicate lead glass, borosilicate zinc glass or borosilicate bismuth glass (i.e., PbO—$SiO_2$ glass, PbO—$B_2O_3$—$SiO_2$ glass, ZnO—$SiO_2$ glass, ZnO—$B_2O_3$—$SiO_2$ glass, BiO—$SiO_2$ glass, and BiO—$B_2O_3$—$SiO_2$ glass); powdered oxides of Na, K, Mg, Ca, Ba, Ti, Zr, Al, etc., such as cobalt oxide, iron oxide, chromium oxide, nickel oxide, copper oxide, manganese oxide, neodymium oxide, vanadium oxide, cerium oxide, titanium dioxide (Tipaque Yellow), cadmium oxide, ruthenium oxide, silica, magnesia, and spinel; fluorescent powders, such as ZnO:Zn, $Zn_3(PO_4)_2$:Mn, $Y_2SiO_5$:Ce, $CaWO_4$:Pb, $BaMgAl_{14}O_{23}$:Eu, ZnS:(Ag, Cd), $Y_2O_3$:Eu, $Y_2SiO_5$:Eu, $Y_3Al_5O_{12}$:Eu, $YBO_3$:Eu, (Y, Gd)$BO_3$:Eu, $GdBO_3$:Eu, $ScBO_3$:Eu, $LUBO_3$:Eu, $Zn_2SiO_4$:Mn, $BaAl_{12}O_{19}$:Mn, $SrAl_{13}O_{19}$:Mn, $CaAl_{12}O_{19}$:Mn, $YBO_3$:Tb, $BaMgAl_{14}O_{23}$:Mn, $LuBO_3$:Tb, $GdBO_3$:Tb, $ScBO_3$:Tb, $Sr_6Si_3O_3Cl_4$:Eu, ZnS:(Cu, Al), ZnS:Ag, $Y_2O_2S$:Eu, ZnS:Zn, (Y, Cd)$BO_3$:Eu, and $BaMgAl_{12}O_{23}$:Eu; powdered metals, such as iron, nickel, palladium, tungsten, copper, aluminum, silver, gold, and platinum. Glass and ceramic powders are particularly preferred for their high transparency. Glass powders (glass frits) are the most effective. It is desirable that the inorganic powder be free from silicon oxide, aluminum oxide or titanium oxide. Presence of these impurities causes turbidity and reduces light transmittance. An inorganic material suitable for fabricating barrier ribs, electrodes, resistors, dielectrics, phosphors, a color filter array or a black matrix is to be chosen from among these inorganic powders.

A suitable particle size of the inorganic powder is in the range of 1 to 10 $\mu$m, preferably 2 to 8 $\mu$m, while varying according to the pattern configuration to be formed. Particles greater than 10 $\mu$m in average cause surface unevenness, which is unfavorable for high precision patterning. Particles smaller than 1 $\mu$m in average cause formation of microvoids on baking, which can cause an insulation failure. The inorganic powder can have a spherical form, a block form, a flaky form, a dendritic form, or a mixture thereof.

The photosensitive paste composition can contain an inorganic pigment of black, red, blue, green, etc. as an inorganic powder to provide a colored pattern, which is fit for the manufacture of color filter arrays, etc. for PDPs. The inorganic powder may be a mixture of particles different in physical properties. For example, a combined use of glass particles or ceramic particles having different thermal softening points is effective to control the shrinkage on baking. The shapes and the physical properties of inorganic powders are combined appropriately according to the characteristics required of barrier ribs, etc.

In order to prevent secondary agglomeration or improve dispersibility of the inorganic powder, being in the range of particle size of 1 to 10 $\mu$m, the particles can be surface treated with organic acids, inorganic acids, silane coupling agents, titanate coupling agents, aluminum coupling agents, surface active agents, or the like in such a range that does not impair the properties of the inorganic powder. The surface treatment is conveniently carried out by dissolving a treating agent in an organic solvent or water, adding the inorganic powder thereto, and removing the solvent by heating the mixture with stirring at about 50 to 200° C. for 2 hours or longer. Otherwise, the treating agent may be added in preparing paste.

The photosensitive paste composition preferably comprises 10 to 35 parts by weight, particularly 15 to 30 parts by weight, especially 20 to 25 parts by weight, of the organic component comprising components (A) to (D) and 65 to 90 parts by weight, particularly 70 to 85 parts by weight, especially 75 to 80 parts by weight, of the inorganic powder per 100 parts by weight of the total composition. Where each component is less than or more than the recited preferred range, necessary performance properties are not secured. For example, if the proportion of the organic component is less than 15 parts, photopolymerization would be insufficient so that image areas would dissolve in developing, resulting in an imaging failure. Where it exceeds 35 parts, the pattern tends to separate on baking.

The photosensitive paste composition usually contains a solvent. Any solvent that has good affinity to the inorganic powder, sufficient dissolving power for the organic component, capability of imparting moderate viscosity to the paste composition, and easy removability by evaporation can be used. Suitable solvents include ketones, such as diethyl ketone, methyl butyl ketone, dipropyl ketone, and cyclohexanone; alcohols, such as n-pentanol, 4-methyl-2-pentanol, cyclohexanol, and diacetone alcohol; ether alcohols, such as ethylene glycol monomethyl ether, ethylene glycol monoethyl ether, ethylene glycol monobutyl ether, propylene glycol monomethyl ether, propylene glycol monoethyl ether, diethylene glycol monomethyl ether, diethylene glycol monoethyl ether, diethylene glycol dimethyl ether, and diethylene glycol diethyl ether; saturated aliphatic monocarboxylic acid alkyl esters, such as n-butyl acetate and amyl acetate; lactic esters, such as ethyl lactate and n-butyl lactate; and ether esters, such as methyl cellosolve acetate, ethyl cellosolve acetate, propylene glycol monomethyl ether acetate, propylene glycol monoethyl ether acetate, ethyl 3-ethoxypropionate, 2-methoxybutyl acetate, 3-methoxybutyl acetate, 4-methoxybutyl acetate, 2-methyl-3-methoxybutyl acetate, 3-methyl-3-methoxybutyl acetate, 3-ethyl-3-methoxybutyl acetate, 2-ethoxybutyl acetate, 4-ethoxybutyl acetate, 4-propoxybutyl acetate, and 2-methoxypentyl acetate. These solvents can be used either individually or as a combination of two or more thereof.

A preferred amount of the solvent to be used for maintaining the paste composition in a suitable viscosity range is 300 parts by weight or less, particularly 10 to 70 parts by weight, especially 25 to 35 parts by weight, per 100 parts by weight of the total amount of the organic component and the inorganic powder.

The photosensitive paste composition of the invention, prepared by dissolving and/or dispersing the organic component and the inorganic powder in a solvent, is applied onto a carrier film to a dry thickness of 10 to 100 $\mu$m and drying the coating layer to form a photosensitive paste composition layer (dry film). The carrier film includes 15 to 125 $\mu$m thick flexible films of synthetic resins, such as polyethylene terephthalate, polyethylene, polypropylene, polycarbonate, and polyvinyl chloride. Application of the composition can be carried out by means of an applicator, a bar coater, a wire bar coater, a roll coater, a curtain flow coater, etc. A roll coater is preferred for film thickness uniformity and efficiency of thick film formation. If necessary, release treatment may be given to the carrier film to facilitate film transfer. The dry film is protected until use by a cover sheet. An about 15 to 125 $\mu$m thick film of polyethylene terephthalate, polypropylene, polyethylene, etc. having a silicone release (baked) coating is suitable as a cover sheet.

PDP manufacturing by the use of the photosensitive paste composition of the invention can be performed as follows. A dry film of the photosensitive paste composition formed on a carrier film is transferred to a substrate, with the cover sheet stripped off beforehand if necessary, and exposed either imagewise (i.e., through a photo mask) or all over the surface. Then the carrier film is removed. The imagewise exposed film is developed to remove the unexposed area. On the other hand, the overall exposed film does not need development. The resulting pattern is then baked. The substrate to which the dry film is transferred includes a glass plate, a glass plate having electrodes (e.g., bus electrodes) formed thereon, and a ceramic plate. The dry film can conveniently be transferred to the substrate by thermal lamination using a hot-roll laminator, etc. Where necessary, the cover sheet is removed beforehand. Thermal lamination with a hot-roll laminator is performed under conditions of substrate surface temperature: 80 to 140° C.; roll pressure: 1 to 5 kg/cm$^2$; and running speed: 0.1 to 10.0 m/min. The substrate can be preheated, e.g., to 40 to 100° C. Radiation emitters which can be used for exposure include ultraviolet emitters generally used in photolithography and aligners used in the manufacture of semiconductors and liquid crystal displays (LCDs).

Development of the imagewise exposed film is conducted with water or a generally used alkaline developer. The alkali component of the alkaline developer includes hydroxides, carbonates, hydrogencarbonates, phosphates or pyrophosphates of alkali metals, e.g., lithium, sodium, and potassium; primary amines, such as benzylamine and butylamine; secondary amines, such as dimethylamine, dibenzylamine, and diethanolamine; tertiary amines, such as trimethylamine, triethylamine, and triethanolamine; cyclic amines, such asmorpholine, piperazine, and pyridine; polyamines, such as ethylenediamine and hexamethylenediamine; ammonium hydroxides, such as tetramethylammonium hydroxide, tetraethylammonium hydroxide, trimethylbenzylammonium hydroxide, and trimethylphenylbenzylammonium hydroxide; sulfoniumhydroxides, such as trimethylsulfonium hydroxide, trimethylsulfonium hydroxide, diethylmethylsulfonium hydroxide, and dimethylbenzylsulfonium hydroxide; choline; and silicate-containing buffers. A proper choice is to be made according to the characteristics of the photosensitive paste composition as to the developing method (e.g., dip development, rocking development, shower development, spray development or paddle development), the development unit, and the developing conditions, such as type, composition, and concentration of the developer, and developing time and temperature.

Since the exposure treatment reduces the tackiness of the photosensitive paste composition layer, the layer does not suffer from release marks when the carrier film is stripped therefrom after exposure.

The baking temperature is selected so as to burn out any organic matter of the cured composition. For example, baking is performed at 400 to 600° C. for 10 to 90 minutes.

According to the PDP production technique of the present invention, the steps involved are simple and easy to carry out, and yet barrier ribs, etc. can be formed with high precision to produce high precision PDPs with good productivity on large scale.

EXAMPLES

The present invention will now be illustrated with reference to Examples, but it should be understood that the invention is not construed as being limited thereto. Unless otherwise noted, all the percents, parts, and ratios are by weight.

Example 1

Preparation of Photosensitive Paste Composition

Twenty-two parts of hydroxypropyl cellulose as component (A), 14 parts of a styrene-hydroxyethyl methacrylate (55/45) copolymer (Mw=40,000) as component (B), 63 parts of 2-methacryloyloxyethyl 2-hydroxypropylphthalate (HO-MPP, available from Kyoeisha Chemical Co., Ltd.) as component (C), 0.9 part of 2,2-dimethoxy-2-phenylacetophenone (IR-651, available from Ciba Geigy-Ltd.) as component (D), 0.1 part of an azo dye (Dye SS, available from Daito Chemix Corp.) as an ultraviolet absorber, and 100 parts of 3-methoxy-3-methylbutanol as a solvent were mixed in an agitator for 3 hours to prepare an organic component mixed solution having a solids content of 50%. Fifty parts of the organic component mixed solution and 75 parts of glass frits were kneaded to prepare a photosensitive paste composition.

Preparation of Photosensitive Dry Film

The paste composition was applied to a polyethylene terephthalate (PETP) carrier film with a slot coater and dried at 100° C. for 6 minutes to completely remove the solvent to form a photosensitive dry film having a thickness of 40 $\mu$m. A 25 $\mu$m thick polyethylene cover sheet was overlaid on the photosensitive dry film.

Evaluation

The resulting dry film was transferred to a glass substrate preheated to 80° C. while stripping off the cover sheet by passing through a hot-roll laminator set at 105° C. The air pressure was 3 kg/cm$^2$, and the laminating speed was 1.0 m/min. The transferred dry film was exposed to ultraviolet light from an ultrahigh-pressure mercury lamp at a dose of 400 mJ/cm$^2$ through a square pattern test mask. The carrier film was then removed. No release marks was left on the dry film. The dry film was developed by spraying with water at 30° C. under a spraying pressure of 3 kg/cm$^2$ for 30 seconds to remove the unexposed area thereby to leave a relief pattern. The minimum line width, taken as a measure of pattern adhesion, was 60 $\mu$m.

In order to evaluate pattern shape stability after baking, the pattern was baked by heating at a rate of 10° C./min up to 580° C. and maintaining at that temperature for 30 minutes. As a result, a satisfactory baked pattern was obtained.

Example 2

A photosensitive dry film was prepared in the same manner as in Example 1, except for increasing the amount of 2,2-dimethoxy-2-phenylacetophenone (photopolymerization initiator) to 1 part and using no ultraviolet absorber. The resulting dry film was transferred to a glass substrate having provided thereon bus electrodes and having been preheated to 80° C. while stripping off the cover sheet by passing through a hot-roll laminator set at 105° C. The air pressure was 3 kg/cm$^2$, and the laminating speed was 1.0 m/min.

The entire surface of the transferred dry film was exposed to ultraviolet light from an ultrahigh-pressure mercury lamp at a dose of 100 mJ/cm$^2$, and the PETP carrier film was removed. No release marks was left on the exposed dry film. In order to evaluate dielectric characteristics, the cured film was baked by heating at a rate of 10° C./min up to 580° C. and maintaining at that temperature for 30 minutes. As a result, a dielectric layer with no variations of discharge voltage was obtained.

Comparative Example 1

Preparation of Paste Composition

Twenty-two parts of hydroxypropyl cellulose as component (A), 14 parts of a styrene-hydroxyethyl methacrylate (55/45) copolymer (Mw=40,000) as component (B), 64 parts of dibutyl phthalate as a plasticizer, and 100 parts of 3-methoxy-3-methylbutanol as a solvent were mixed in an agitator for 3 hours to prepare an organic component mixed solution having a solids content of 50%. Fifty parts of the mixed solution and 75 parts of glass frits were kneaded to prepare a paste composition.

Preparation of Dry Film

The resulting paste composition was applied to a PETP carrier film with a slot coater and dried at 100° C. for 6 minutes to completely remove the solvent to form a 40 $\mu$m thick dry film. A 25 $\mu$m thick polyethylene cover sheet was overlaid thereon.

Evaluation

The resulting dry film was transferred to a glass substrate having provided thereon bus electrodes and having been preheated to 80° C. while stripping off the cover sheet by passing through a hot-roll laminator set at 105° C. The air pressure was 3 kg/cm$^2$, and the laminating speed was 1.0 m/min. When the cover sheet was stripped from the dry film, the film underwent release marks. In order to evaluate dielectric characteristics, the film was baked by heating at a rate of 10° C./min up to 580° C. and maintaining at that temperature for 30 minutes. As a result, the dielectric layer caused variations of discharge voltage in the areas suffering from release marks, which, when used in a PDP, resulted in brightness unevenness as a display defect.

Comparative Example 2

A photosensitive dry film was prepared in the same manner as in Example 2. The dry film was transferred to a glass substrate having provided thereon bus electrodes and having been preheated to 80° C. while stripping off the cover sheet by passing through a hot-roll laminator set at 105° C. The air pressure was 3 kg/cm$^2$, and the laminating speed was 1.0 m/min.

Thereafter, the PETP carrier film was stripped from the dry film, which resulted in release marks on the dry film. In order to evaluate dielectric characteristics, the photosensitive dry film was exposed to ultraviolet radiation from an ultrahigh-pressure mercury lamp at an exposure energy of 100 mJ/cm$^2$ and baked by heating at a rate of 10° C./min up to 580° C. and maintaining at that temperature for 30 minutes. As a result, the dielectric layer caused variations of discharge voltage in the areas suffering from release marks, which, when used in a PDP, resulted in brightness unevenness as a display defect.

According to the PDP production process of the invention, a photosensitive dry film does not suffer from release marks when a carrier film is stripped therefrom, and barrier ribs, etc. can be formed with high precision. These advantages are realized by the simple manipulation of exposure followed by removal of the carrier film, which offer a high industrial value.

This application is based on Japanese Patent application JP 2001-133810, filed May 1, 2001, the entire content of which is hereby incorporated by reference, the same as if set forth at length.

What is claimed is:

1. A process of producing a plasma display panel comprising, in this order, the steps of:

forming a photosensitive paste composition layer on a carrier film;

transferring the photosensitive paste composition layer onto a substrate;

exposing the photosensitive paste composition layer;

removing the carrier film; and baking the exposed composition layer to fabricate at least one of barrier ribs, electrodes, resistors, dielectrics, phosphors, a color filter array, and a black matrix, wherein the step of exposing is overall exposure, and the process includes no step of developing after the step of removing the carrier film and before the step of baking.

2. The process of producing a plasma display panel according to claim 1, wherein the photosensitive paste composition comprises a water-soluble cellulose derivative, a photopolymerizable monomer, an acrylic resin having a hydroxyl group, a photopolymerization initiator, an inorganic powder, and a solvent.

3. The process of producing a plasma display panel according to claim 2, wherein the inorganic powder is glass powder.

4. A process of producing a plasma display panel comprising, in this order, the steps of:

forming a photosensitive paste composition layer on a carrier film;

transferring the photosensitive paste composition layer onto a substrate;

exposing the photosensitive paste composition layer;

removing the carrier film; and baking the exposed composition layer to fabricate a dielectric layer, wherein the step of exposing is overall exposure, and the process includes no step of developing after the step of removing the carrier film and before the step of baking.

5. The process of producing a plasma display panel according to claim 4, wherein the photosensitive paste composition comprises a water-soluble cellulose derivative, a photopolymerizable monomer, an acrylic resin having a hydroxyl group, a photopolymerization initiator, an inorganic powder, and a solvent.

6. The process of producing a plasma display panel according to claim 5, wherein the inorganic powder is glass powder.

* * * * *